US009433815B1

(12) United States Patent
Hughes

(10) Patent No.: US 9,433,815 B1
(45) Date of Patent: Sep. 6, 2016

(54) EXERCISE AND REHABILITATION APPARATUS WITH ADJUSTABLE CONSTANT LOAD RESISTANCE UNIT

(71) Applicant: Hughes Super Flex, Inc., Novato, CA (US)

(72) Inventor: Paul G Hughes, Novato, CA (US)

(73) Assignee: Hughes Super Flex, Inc., Novato, CA (US)

( * ) Notice: Subject to any disclaimer, the term of this patent is extended or adjusted under 35 U.S.C. 154(b) by 0 days.

(21) Appl. No.: 14/727,841

(22) Filed: Jun. 1, 2015

Related U.S. Application Data

(60) Provisional application No. 62/141,178, filed on Mar. 31, 2015.

(51) Int. Cl.

| | |
|---|---|
| ***A63B 21/015*** | (2006.01) |
| ***A63B 21/00*** | (2006.01) |
| ***A63B 21/018*** | (2006.01) |
| ***A63B 23/035*** | (2006.01) |

(52) U.S. Cl.
CPC ..... *A63B 21/015* (2013.01); *A63B 21/00029* (2013.01); *A63B 21/00069* (2013.01); *A63B 21/018* (2013.01); *A63B 21/1446* (2013.01); *A63B 21/1469* (2013.01); *A63B 21/1496* (2013.01); *A63B 23/0355* (2013.01)

(58) Field of Classification Search
CPC ..... A63B 21/015; A63B 21/00069; A63B 21/4035; A63B 23/1209; A63B 23/12; A63B 21/4043; A63B 23/03541; A63B 2208/0204; A63B 21/4049; A63B 23/03533; A63B 21/012; A63B 21/157; A63B 21/025; A63B 23/03508; A63B 23/1281; A63B 21/4017; A63B 21/023; A63B 22/0605; A63B 21/22; A63B 2022/0676; A63B 2071/0694; A63B 21/00076; A63B 2022/0617; A63B 2022/0623; A63B 21/0052; A63B 21/0056; A63B 2225/107; A63B 22/0002; A63B 23/1245; A63B 2022/067; A63B 21/1484; A63B 21/1469; A63B 21/0442; A63B 21/1403; A63B 21/1407; A63B 21/1411; A63B 21/1415; A63B 21/1476; A63B 21/1434; A63B 21/1449
USPC ..... 482/114–115, 118–119
See application file for complete search history.

(56) References Cited

U.S. PATENT DOCUMENTS

| | | | | | |
|---|---|---|---|---|---|
| 2,668,709 | A * | 2/1954 | Boyko | A63B 22/0007 | 482/60 |
| 3,309,084 | A * | 3/1967 | Simmons | A63B 21/015 | 280/43.17 |
| 4,060,241 | A * | 11/1977 | Hegel | A63B 21/015 | 482/60 |
| 4,257,588 | A * | 3/1981 | Ketchman | A63B 22/0012 | 482/62 |
| 4,417,724 | A * | 11/1983 | Bikker | A63B 21/015 | 188/251 A |

(Continued)

*Primary Examiner* — Stephen Crow
*Assistant Examiner* — Andrew S Lo
(74) *Attorney, Agent, or Firm* — Gary Hoenig

(57) ABSTRACT

An exercise and rehabilitation apparatus is provided having resistance load units comprising a resistance drum rotabably coupled to a user crank handle mechanism, a friction strap surrounds the resistance drum wherein the level of friction resistance between the drum and the resistance load unit housing is user selectable thereby selecting the force required to rotate the user crank. Once user adjusted the resistance load unit provides a constant load to the user crank. Resistance load units are mounted opposingly providing a left and right hand user crank. A variety of user crank embodiments are provided for simulating the forces and motion experienced by a user in various sporting, exercising and rehabilitation user activities.

18 Claims, 9 Drawing Sheets

(56) References Cited

U.S. PATENT DOCUMENTS 4,919,238 A * 4/1990 Skipper ..... A63B 21/015 182/234
4,986,537 A * 1/1991 D'Orta ..... A63B 21/00178 482/105
5,039,091 A * 8/1991 Johnson ..... A63B 21/157 428/110
5,062,633 A * 11/1991 Engel ..... A63B 21/015 482/118
5,178,598 A * 1/1993 Finch ..... A63B 21/015 473/429
5,580,338 A * 12/1996 Scelta ..... A63B 22/0002 482/114
6,482,138 B1 * 11/2002 Nelson ..... A63B 21/015 482/118
9,199,114 B1 * 12/2015 Santoro ..... A63B 21/015
2002/0077227 A1 * 6/2002 Bastyr ..... A63B 21/0004 482/118
2003/0216229 A1 * 11/2003 Bastyr ..... A63B 21/157 482/115
2004/0043873 A1 * 3/2004 Wilkinson ..... A63B 22/0005 482/54
2005/0043152 A1 * 2/2005 Krietzman ..... A63B 22/0005 482/115
2007/0184937 A1 * 8/2007 Graber ..... A63B 21/015 482/52
2008/0076644 A1 * 3/2008 Rutherford ..... A63B 21/015 482/114
2008/0318738 A1 * 12/2008 Chen ..... A63B 21/015 482/57

* cited by examiner

FIG. 6
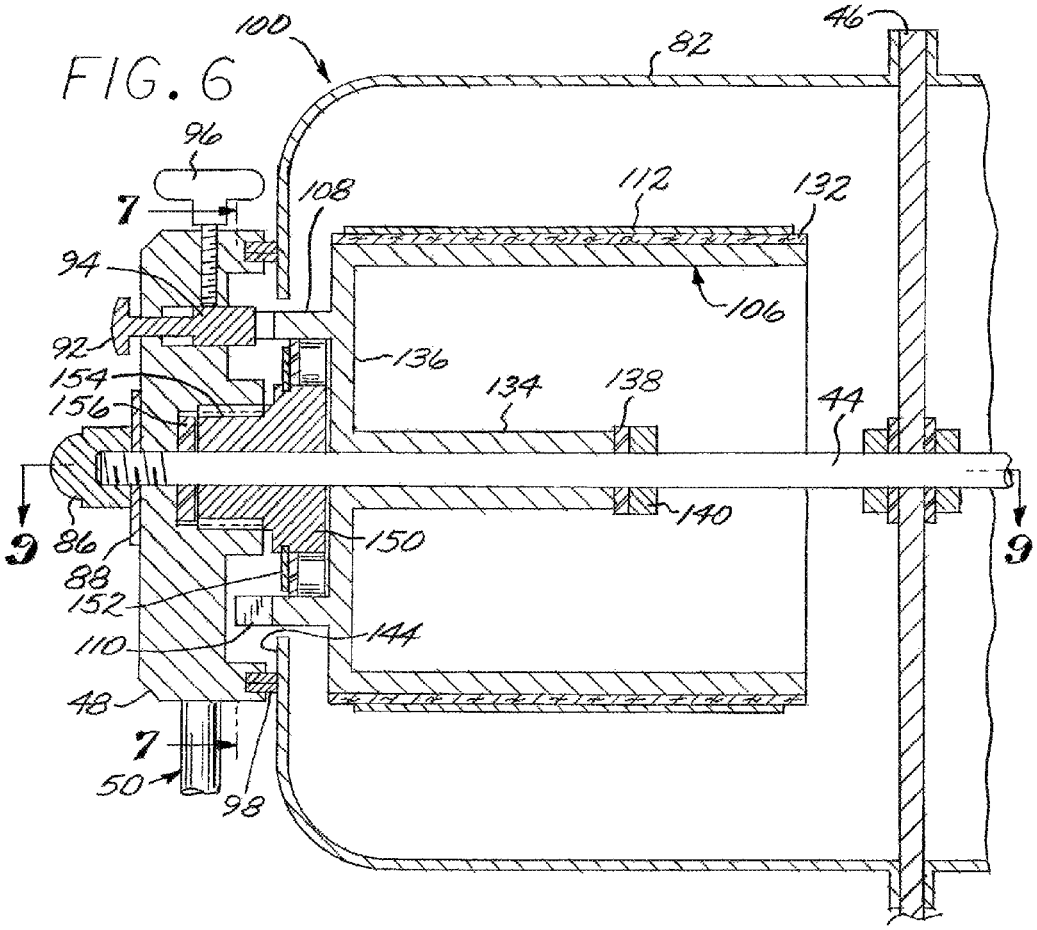
FIG. 7
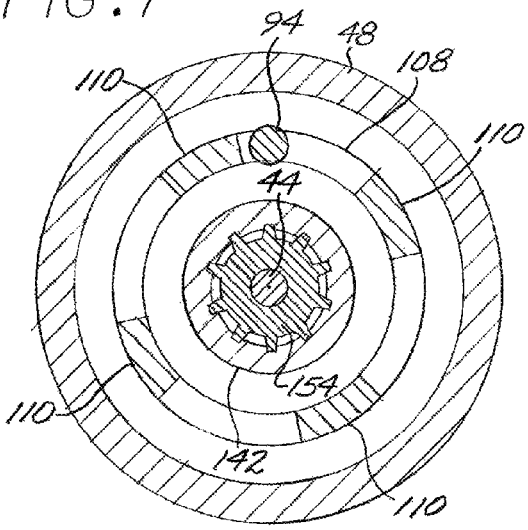
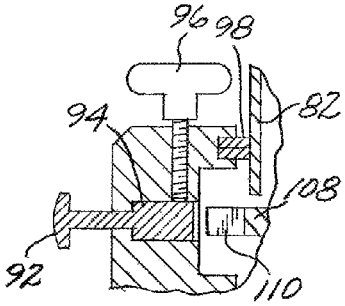
FIG. 8

EXERCISE AND REHABILITATION APPARATUS WITH ADJUSTABLE CONSTANT LOAD RESISTANCE UNIT

This non-provisional utility patent application, filed in the United States Patent and Trademark Office, claims the benefit of U.S. Provisional Patent Application Ser. No. 62/141,178 filed Mar. 31, 2015 which is hereby incorporated by reference.

FIELD OF THE INVENTION

The invention relates to exercise and rehabilitation equipment; and, more particularly, to exercise apparatuses providing adjustable and constant load resistance to a user.

BACKGROUND OF THE INVENTION

Many variations of exercise machines are provided in the prior art typically utilizing elastomeric bands or weights and pulleys as the means for providing a resistance load to a user. There are many limitations related to the use of bands and weights that typically restrict the use of the machine to exercising a specific set of muscles, consequently there are many exercise machines directed to specific uses. Further, the mechanisms for creating the load to a user typically provide a varying load throughout the range of motion. What is needed is an exercise apparatus that is configurable for exercising many different muscle groups and provides constant resistance load, safety, and durability.

SUMMARY OF THE INVENTION

Accordingly, the present invention is directed to an improved exercise and rehabilitation station providing adjustable and constant resistance load throughout the exercise stroke, and, more specifically, to an apparatus providing simulation of the motion and forces experienced whilst conducting particular sporting, exercise, and rehabilitation activities. The apparatus presents a preselected constant load to a user throughout the full stroke of motion without utilizing weights and pulleys or elastomeric bands typically incorporated in prior art devices. Further elastomeric bands vary in load throughout the stroke and inherently have limited motion direction making simulation of activities cumbersome. Similarly weights and pulleys have similar motion limitations as well as safety concerns.

An objective of the present invention is to provide a constant load to a user throughout the range of motion whilst using the apparatus. An adjustable and constant resistance load unit is provided wherein a rotatable hub presents a constant resistance to turn by a user. The resistance unit comprises a rotatable drum and a means for adjusting the tension of a tensioner band against the top of a friction strap disposed around the drum wherein increasing the tension on the band increases the friction between the strap and the drum thereby increasing the force required to rotate the resistance drum. A sprag clutch is further provided disposed between the hub and the drum engaging the hub rotation with the drum rotation and restricting the rotational direction of the engagement.

The resistance units may be utilized in tandem to accommodate both arms of the user. Various attachments may be optionally fixed to the hub to provide simulated range of motion thereby exercising the muscle groups associated with the motion. The apparatus has many advantages over the prior art as it is highly configurable, effectively simulates the range of motion and load experienced in many sporting activities, and provides safe and reliable load to a user for exercise, thereby substantially obviating one or more of the problems due to the limitations and disadvantages of the related art.

BRIEF DESCRIPTION OF THE DRAWINGS

The accompanying drawings, which are incorporated in and constitute a part of this specification illustrate embodiments of the invention and, together with the description, serve to explain the features, advantages, and principles of the invention.

In the drawings:

FIG. 6 is a vertical cross section view taken on Line 6-6 of FIG. 2 showing the assemblage and spatial relationship of the various elements of the resistance unit.

FIG. 7 is a cross section view taken on Line 7-7 of FIG. 6 illustrating the interconnectivity of the hand hub with the spline of the sprag clutch and the surrounding dog gear of the resistance drum wherein a drum locking pin is disposed within the dog gear to lock the rotation of the handle hub to the resistance drum.

FIG. 8 is an inset cross section view taken on Line 10-10 of FIG. 9 showing details of the drum locking pin T handle bolt in the handle hub and securing the locking pin in the disengaged position.

DETAILED DESCRIPTION OF THE INVENTION

Figure 1:
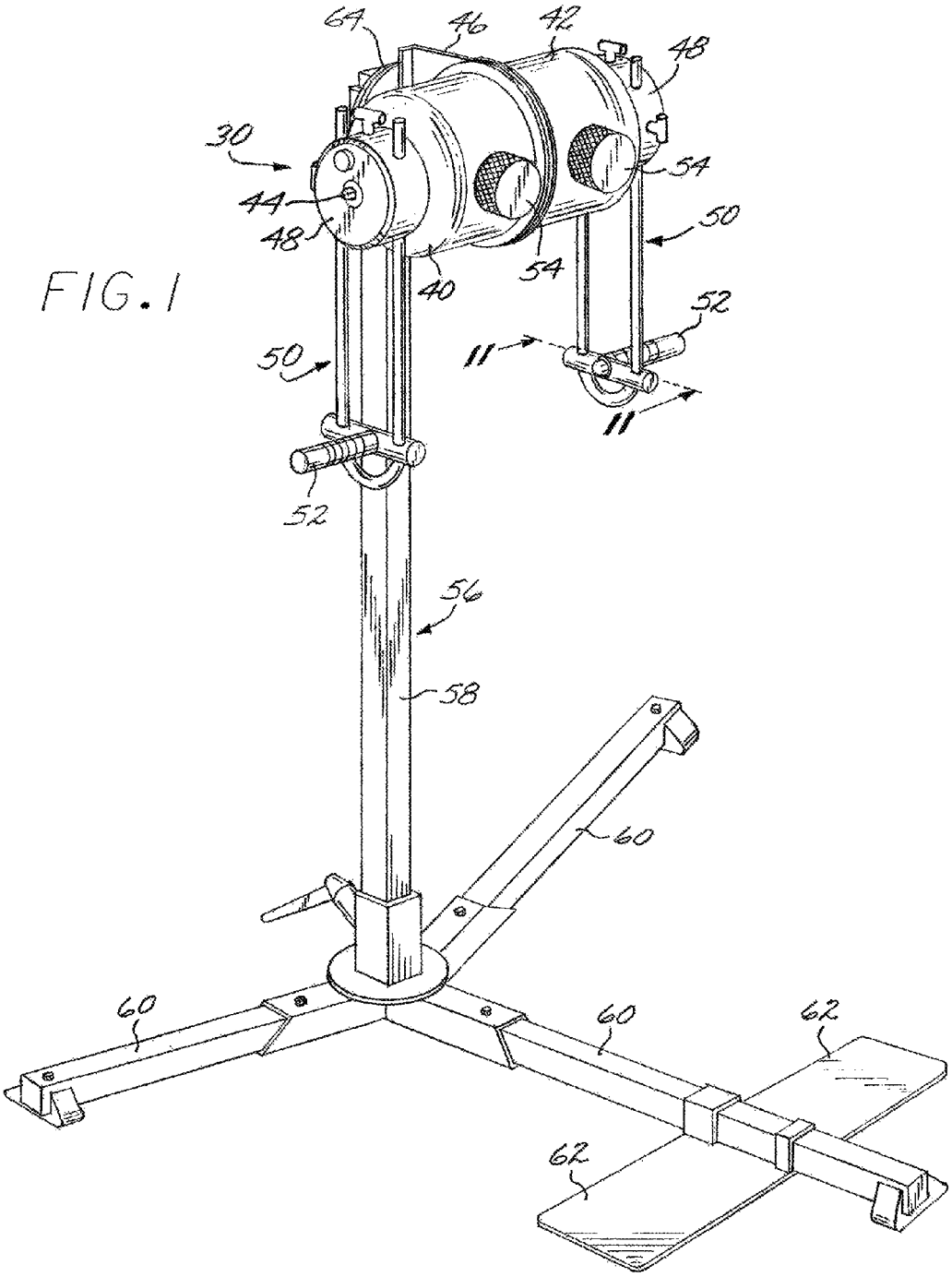
FIG. 1 is a perspective view of the exercise apparatus according to the present invention.

Although particular embodiments of the invention have been described in detail for purposes of illustration, various modifications may be made without departing from the spirit and scope of the invention. Where examples are presented to illustrate aspects of the invention, these should not be taken as limiting the invention in any respect. Referring now in greater detail to the various figures of the drawings wherein like reference characters refer to like parts, there is shown in a perspective view at 30 in FIG. 1, a new type of exercise, fitness and rehabilitation machine.

Referring to FIG. 1, a perspective view according to the present invention, the exercise apparatus 30 comprises left and right constant load resistance units 40 and 42 each having a central shaft 44, opposingly and symmetrically fixed at the proximate end to opposing sides of a mounting plate 46 arranged perpendicular to the central shaft 44 of the resistance units 40 and 42, each resistance unit having a handle hub 48, rotatably mounted at the resistance unit distal end and arranged to rotate around the central shaft, receiving a user crank 50 with a grip 52 wherein the resistance units respectively define the force required to rotate the respective handle hubs. The resistance units 40 and 42 each further provide a tensioner adjustment knob 54 facilitating a user to select the force required to rotate the handle hub 48.

Mounting plate 46 is adaptable to receive a variety of optional mounting devices. Referring again to FIG. 1 wherein an embodiment of an optional vertical mounting stand 56 is illustrated. In the illustrated embodiment, the mounting plate 46 is perpendicularly fixed to a mounting bracket 64 received by the top end of the vertical member 58 of the optional vertical mounting stand 56. The vertical member 58 is removably fixed at the bottom end to a plurality of ground support members 60 extending radially from the vertical member 58. Stabilizing plates 62 attached to the ground support members 60 extend perpendicularly from the ground support members 60 providing a platform for a user to stand upon to further stabilize the apparatus. It will be appreciated that various other means for mounting the apparatus may be utilized.

Figure 2:
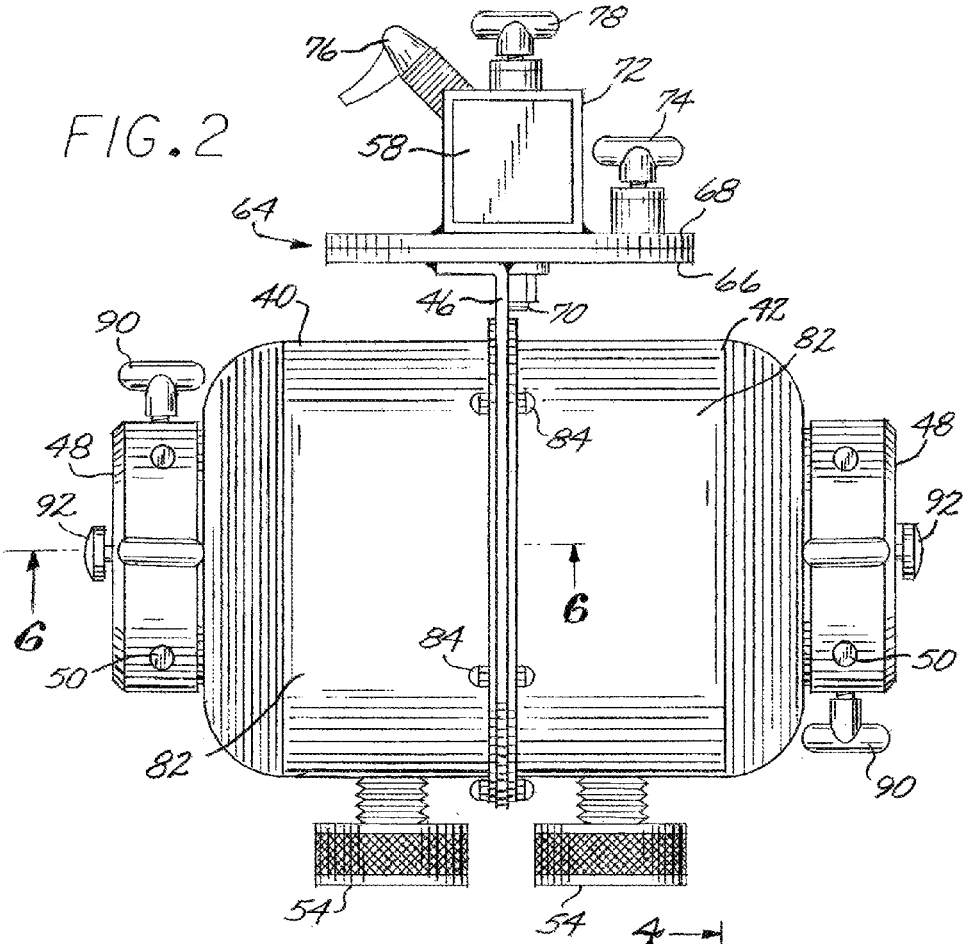
FIG. 2 is a top plan view of the dual resistance unit according to the present invention showing the unit optionally mounted to a vertical stand.
Figure 3:
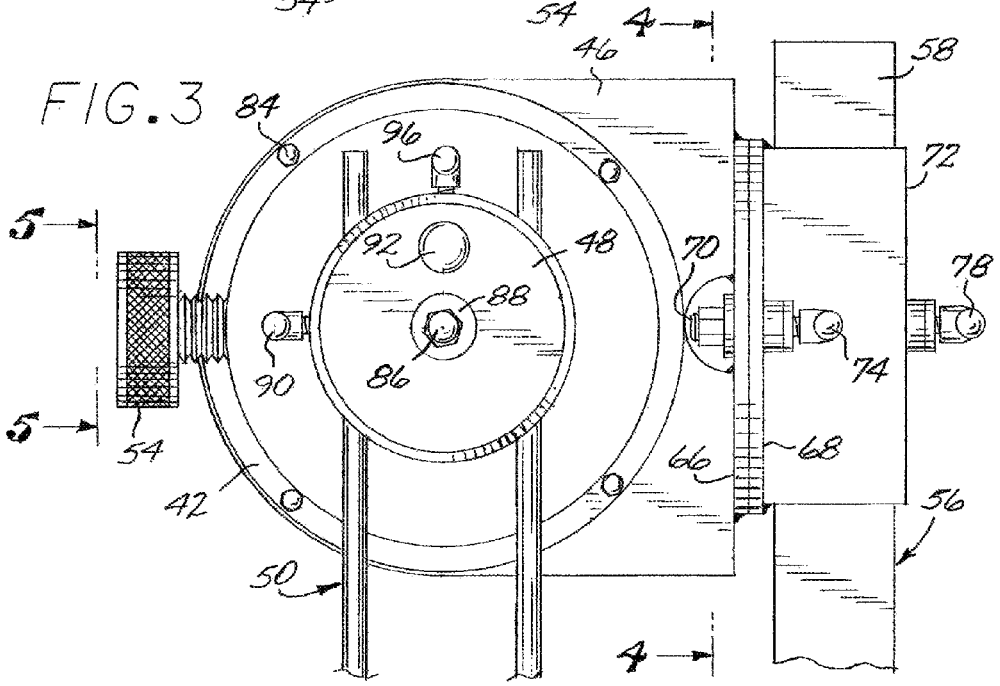
FIG. 3 is a right side elevation view of the of the dual resistance unit of FIG. 2.
Figure 4:
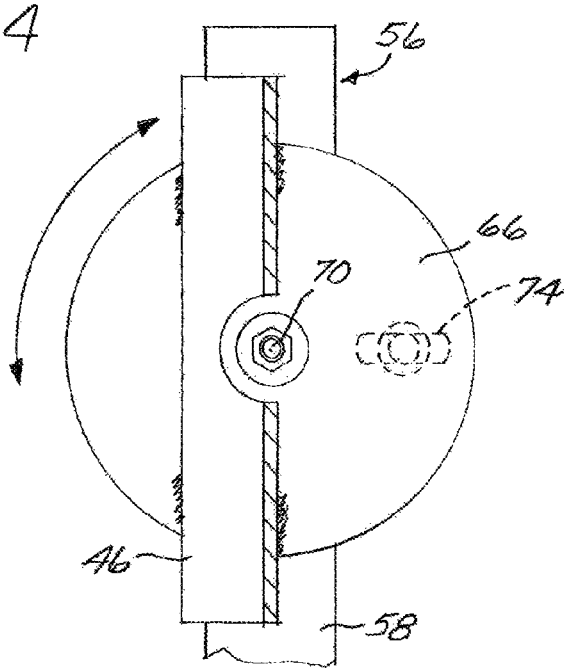
FIG. 4 is a cross section view taken on Line 4-4 of FIG. 3 showing details of the rotatable mounting plate attachment received by the optional vertical stand.
Figure 13:
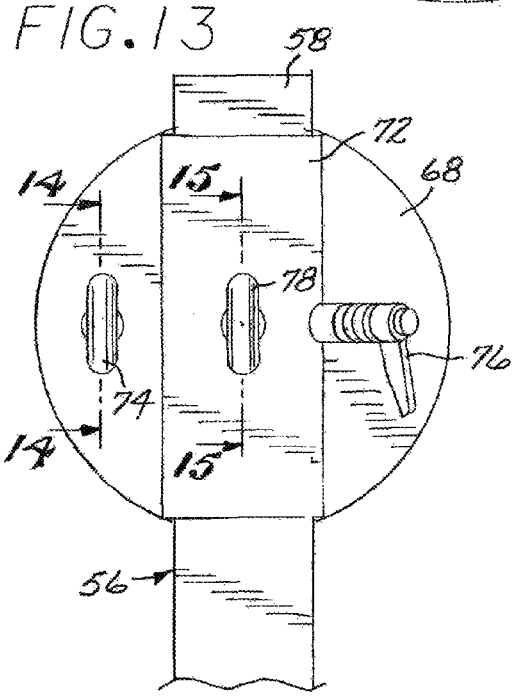
FIG. 13 is a rear elevation view of the exercise apparatus according to the present invention illustrating the various adjustment handles providing user selectable resistance unit mounting positions relative to an optional vertical stand.
Figure 14:
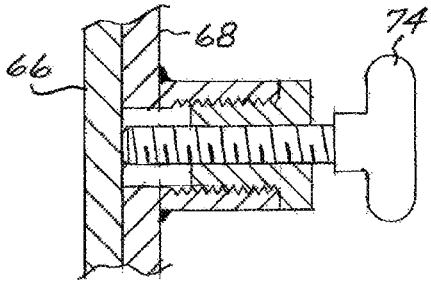
FIG. 14 is a cross section view taken on Line 14-14 of FIG. 13 illustrating the rotational position locking T handle bolt securing the rotational position of the resistance unit relative to the optional vertical stand.
Figure 15:
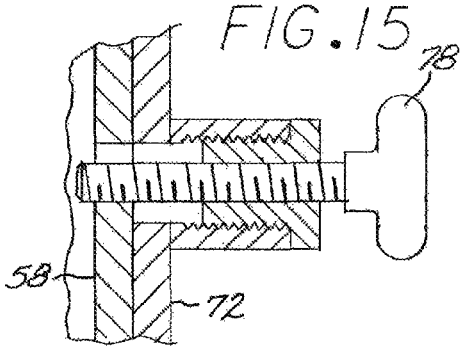
FIG. 15 is a cross section view taken on Line 15-15 of FIG. 13 illustrating the height position locking T handle bolt being received by a bore in the vertical stand securing the user selectable vertical height position of the resistance unit relative to the optional vertical stand.
Figure 16:
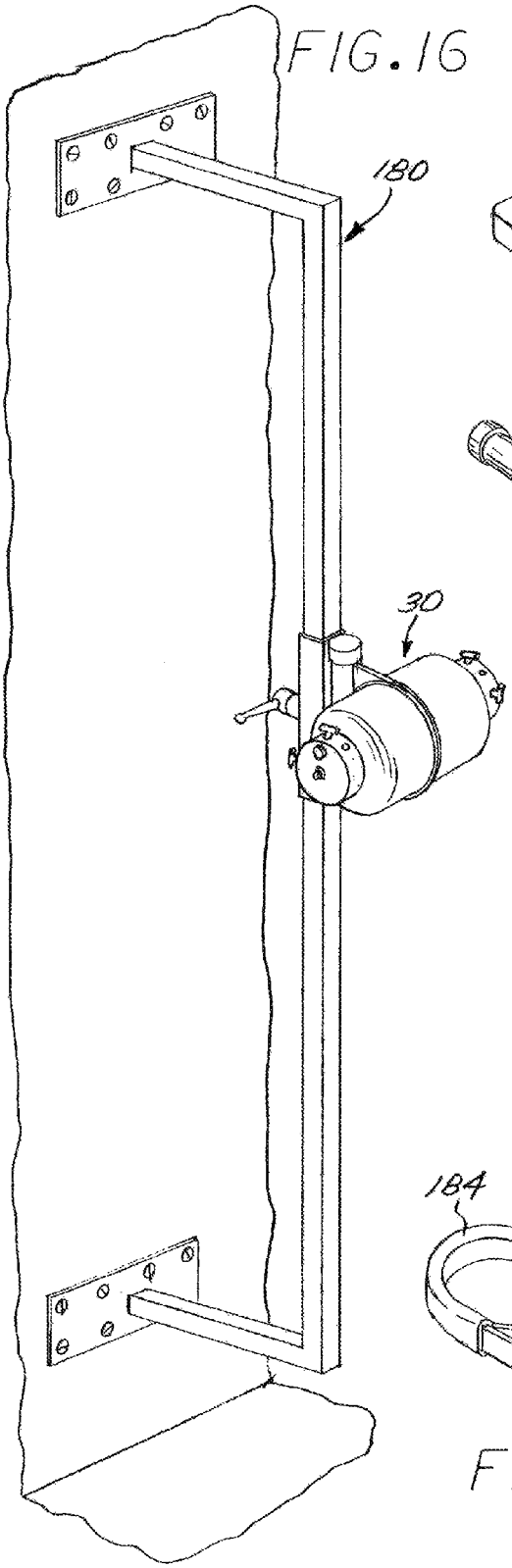
FIG. 16 is a perspective view of an alternate wall mount embodiment of the stand.

Details of the mounting bracket 64 are illustrated in FIGS. 2 and 3 wherein the mounting bracket 64 comprises a front plate 66 perpendicularly attached to the mounting plate 46, a rear plate 68 rotatably disposed adjacent to the front plate 66 and being secured by mount shaft 70 disposed through central bores in the front and rear plates. As shown further in FIGS. 4, 13 and 14, the rotational position of the front plate 66 relative to the rear plate 68 is locked by the user utilizing mount bracket T handle bolt rotation lock 74 disposed as a set screw to bind the front and rear plates together to prevent rotation. A mounting sleeve 72 fixed to the rear plate 68 receives the top end of the vertical member 58 of the mounting stand 56 as in FIG. 13. A levered height lock 76 is threaded through the mounting sleeve 72 and disposed as a set screw to selectively bind the vertical member 58 within the sleeve 72 thereby securing the vertical height. A T handle safety pin 78 is arranged to penetrate the sleeve 72 and is received by bores in the vertical member 58 thereby insuring that the vertical height adjustment remains secure as in FIGS. 13 and 15. An alternate embodiment of the optional vertical stand is illustrated in FIG. 16 showing a wall mount stand 180 being received by the apparatus 30 of the present invention. It will be appreciated that the mounting bracket 64 is adaptable to receive a variety of optional mounting devices.

Again referring to FIG. 2 showing a top plan view of the present invention, the left 40 and right 42 resistance units are comprised of the same elements and have identical assemblage. The units differ only in rotational restriction of the handle hubs 48 so as to provide complimenting left and right motion. The housings 82 of the units are mounted opposingly on the mounting plate 46 by housing fasteners 84 wherein the unit housing central shafts 44 are disposed in line with each other such that the handle hubs 48 rotate around the same axis.

In FIG. 3, showing a right side elevation view, the handle hub 48 is fixed to the central shaft 44 by handle hub retainer fastener 86 and handle hub retainer washer 88 wherein the handle hub 48 and associated elements form the distal end of the unit 42. The handle hub 48 receives a handle or user crank 50 and is gripped in place by the hub crank T handle bolt 90. Also visible is the hub rotation lock pin knob 92 attached to the hub rotation lock pin 94 that slides within a bore within the handle hub 48 and is selectively secured in position by the pin securing T handle bolt 96 being received by a threaded bore perpendicular to the pin bore in the handle hub 48.

Figure 5:
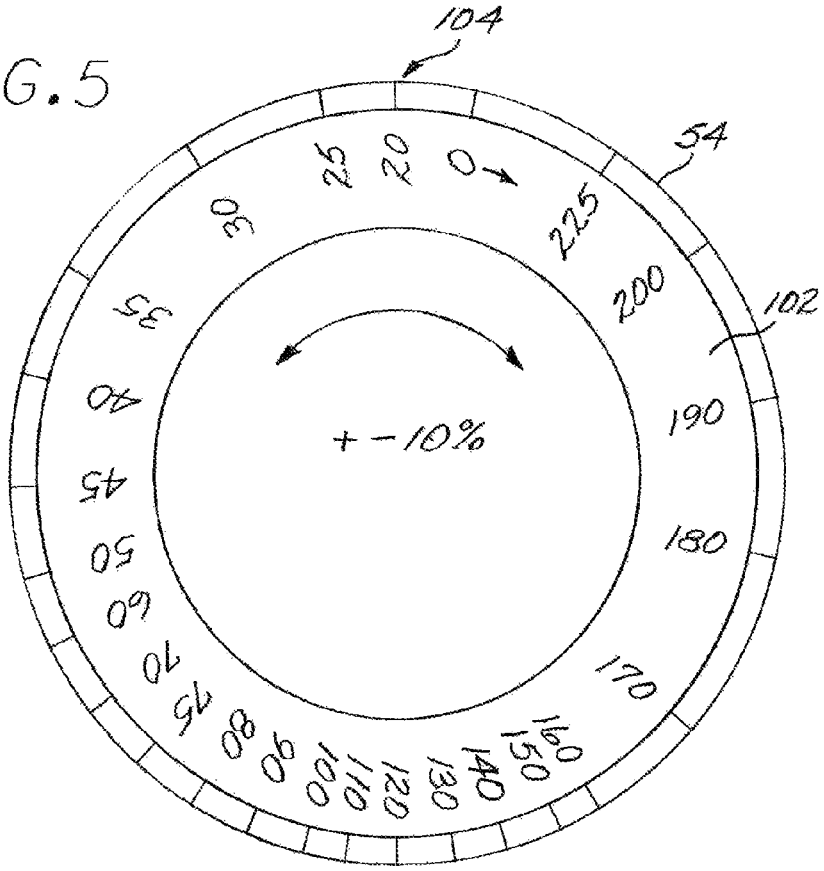
FIG. 5 is a front elevation view taken on Line 5-5 of FIG. 3 illustrating the face of the resistance band tensioner adjustment knob of the right hand resistance unit showing the resistance load markings.

A user rotates the user crank 50 around the axis of the resistance unit 42. The resistance unit provides resistance to the rotation. As in FIG. 5, the amount of resistance is user selectable by rotating the tensioner knob 54 to a position corresponding to the load required. The tensioner knob 54 has load markings 102 wherein the selected indicia is rotated to the vertical position thereby setting the resistance load presented to the handle hub 48. In FIG. 5, the load setting of twenty is shown selected at 104.

The essential component of the present invention is the resistance unit. A cross section of an embodiment of the resistance unit 100 is shown in FIG. 6, a view taken on Line 6-6 of the left resistance unit 40 of FIG. 2. A resistance drum 106 having a cylindrical shape with the distal end being a plate 136 having a concentrically and longitudinally disposed cylindrical bearing housing 134 surrounding the central shaft 44 of the unit 100. The drum 106 is free to rotate around the central shaft 44 and is secured in position at the proximate end by rear thrust washer 138 and a lock nut 140 received by threads on the central shaft 44. A dog gear 108 is concentrically disposed and fixed on the plate 136 of the resistance drum 106 with the dog gear engagement teeth 110 arranged along the periphery and extending outwardly and perpendicularly from the resistance drum plate 136. The dog gear 108 has a central recess forming a housing for a sprag clutch 150 centrally disposed within the housing. The sprag clutch is a typical one-way freewheel clutch with inner and outer races permitting rotation in one direction. The sprag clutch 150 is secured within the housing by a sprag clutch retainer ring 152. A spline 154, being secured in place by spline thrust bearing 156, is in direct mechanical communication with the central portion of the sprag clutch 150 and engages the spline receiver 142 of the handle hub 48 wherein the sprag spline 154 is free to rotate around the central shaft 44. As the housing of the dog gear 108 is contiguous with the resistance drum 106, a mechanical linkage is formed from the handle hub 48, through the spline 154, through the sprag clutch 150 and to the resistance drum 106. Sprag clutches inherently permit rotation in one direction only therefore in one direction of rotation the handle hub 48 rotation is the same as the resistance drum 106 whilst in the opposite direction of rotation the handle hub 48 is free to rotate without engaging the resistance drum 106. Therein lies the only distinction between the left 40 and right 42 resistance units as the sprag clutch permitted rotation directions oppose each other.

The user may optionally defeat the rotation of the sprag clutch 150 by engaging the rotation lock pin 94 with the dog gear teeth 110. In the lock position, as illustrated in FIGS. 6 and 7, the handle hub 48 and the resistance drum 106 must rotate together in both rotational directions of the handle hub 48. In the unlocked position, as illustrated in FIG. 8, the rotation lock pin 94 is withdrawn into the handle hub 48 and does not engage the teeth 110 of the dog gear 108. The sprag clutch 150 is therefore re-engaged and the rotation restriction is restored. The lock pin securing T handle bolt 96 provides the functionality of a set screw to secure pin 94 in place in the unlocked position as in FIG. 6 and the locked position as in FIG. 8.

The handle hub 48 being secured to the central shaft 44 by retainer fastener 86 is drawn against the hub bearing surface 144 of the resistance unit housing 82 by tightening the fastener 86. A bearing material, being the handle hub bearing 98, is disposed between the hub 48 and the bearing surface 144 to permit rotation of the handle hub 48. The bearing material may be nylon or other similar materials.

Figure 9:
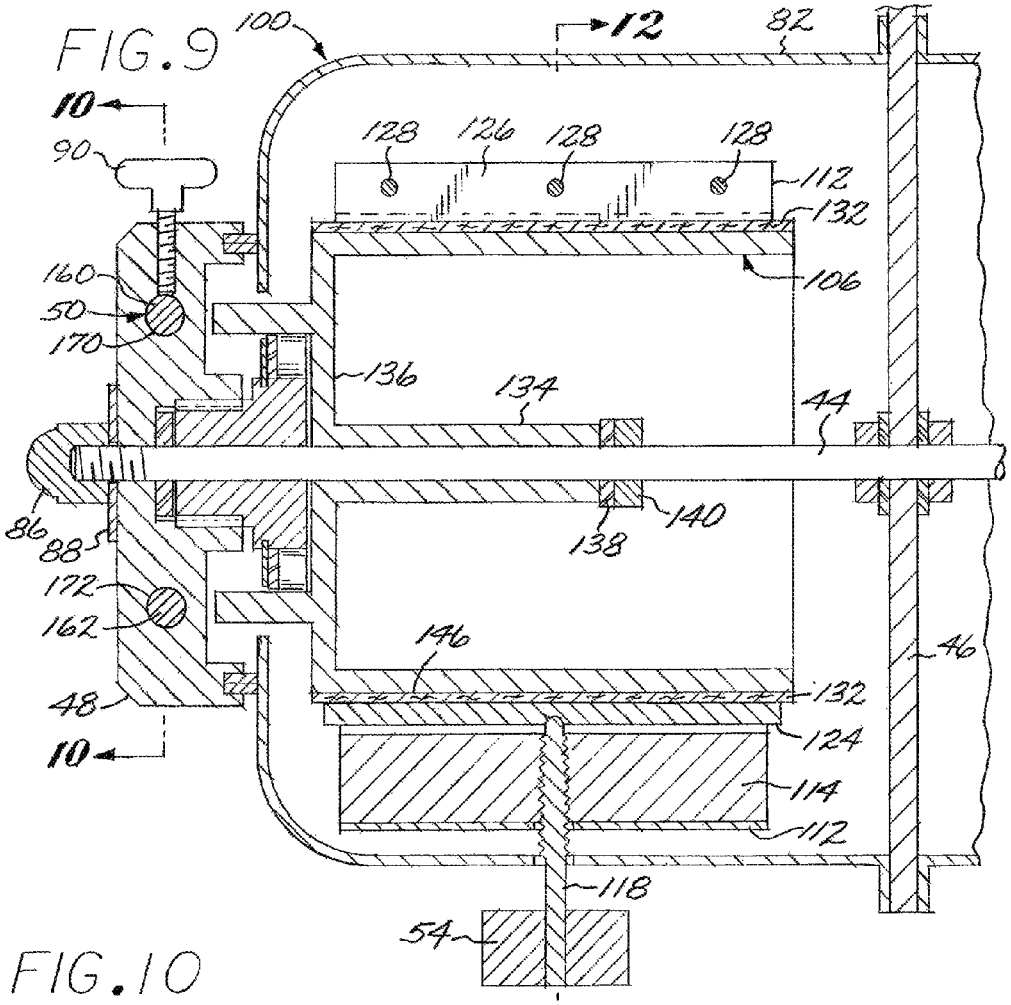
FIG. 9 is a horizontal cross section view taken on Line 9-9 of FIG. 6 further showing details of the resistance drum, resistance band, tensioner band and tensioner band adjustment knob.

Referring now to FIG. 9 a cross section of the resistance unit 100 taken on Line 9-9 of FIG. 6 wherein the resistance generating elements are shown in greater detail. The outside circumference of the resistance drum 106 is polished to form a smooth resistance friction surface 146. The bottom of the resistance band friction strap 132 surrounds the drum surface 146. The strap 132 is formed from a fabric material having a friction coefficient with metal sufficiently to grasp the drum when pressure is applied to the strap whilst sufficiently low to allow the drum to rotate when no pressure is applied. The strap 132 is held in position around the circumferential surface of drum 106 by pinching and securing the material between flanges 126 of the resistance band 112 contacting the top side of the strap 132 thereby preventing the friction strap 132 from turning with the drum 106. The resistance band 112 is constructed from flexible metal sheeting disposed around the strap 132, resistance band shoe 124 and tensioner receiver 114. The resistance shoe 124 is a plate having a curvature to complement the curvature of the drum 106 and is positioned against the outer surface of the friction strap 132. The tensioner receiver 114 is a rectangular box shaped element disposed between the top of the resistance shoe 124 and the inside surface of the resistance band 112. The tensioner knob 54 has a threaded shaft 118 inserted through the resistance unit housing 82, through a bore in the resistance band 112 and received by a threaded bore through the tensioner receiver 114 wherein the distal end of the shaft 118 contacts the top surface of the resistance shoe 124. Turning the tensioner knob 54 threads the tensioner shaft 118 further into the tensioner receiver 114 pressing the tensioner receiver 114 against the inside surface of the resistance band 112 and also increasing the pressure of the resistance shoe 124 against the friction strap 132. The resistance band 112 responsively tightens against the friction strap 132 around the resistance drum 106. The combination of increased pressure on the resistance shoe 124 and the increased pressure from the resistance band 112 on the friction strap 132 increases the force required to rotate the handle hub 48 thereby accomplishing the selection of the constant load of the resistance unit 100 of the apparatus.

Figure 12:
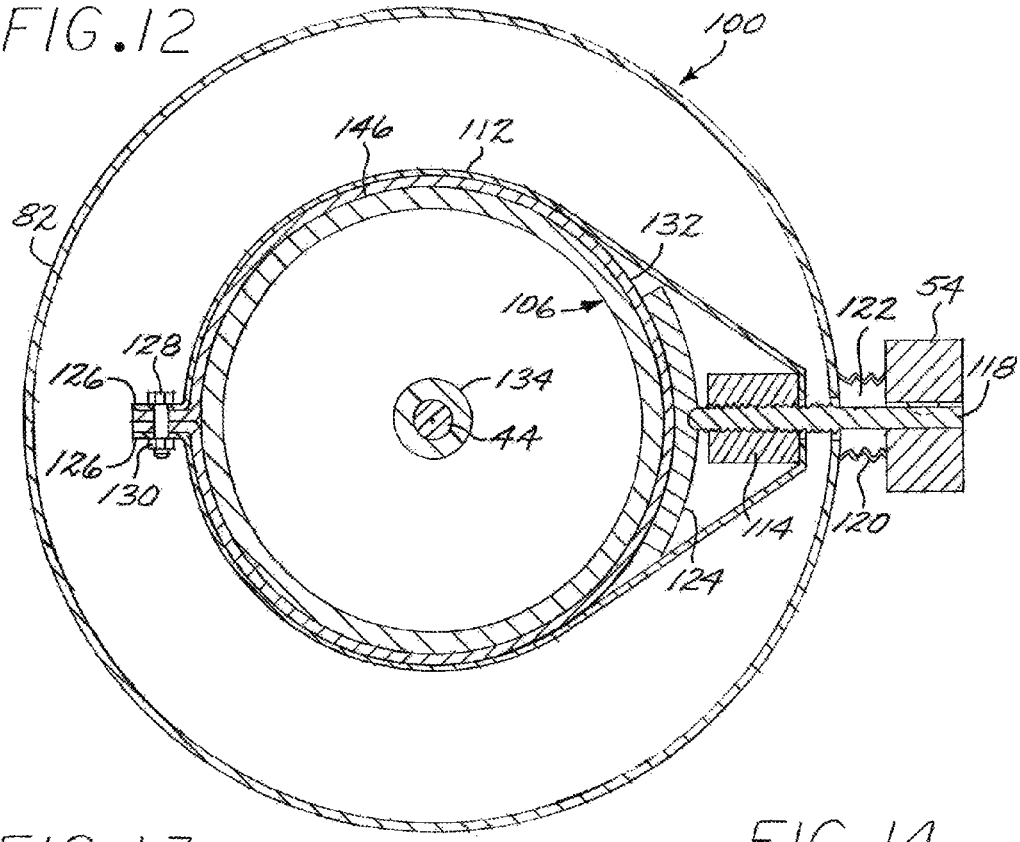
FIG. 12 is a cross section view taken on Line 12-12 of FIG. 9 showing additional details of the resistance drum, resistance band, tensioner band and tensioner band adjustment knob.

As in FIG. 12, the resistance band 112, being formed from a sheet of metal, has a flange 126 as each end. The flanges 126 are bolted together with flange fasteners 128 and flange fastener nuts 130. The ends of friction strap 132 are disposed between the flanges 126 and secured by the fasteners. The length of the friction strap 132 is determined by the outside diameter of the resistance drum 106 wherein the friction strap 132 fits snugly against the friction surface 146 of the resistance drum 106.

An optional protective dust cover 120 around the tensioner knob threaded shaft 118, is disposed between the housing 82 and the bottom of the tensioner knob 54. Optional shaft packing material 122 fills the voids within the dust cover 120.

Figure 10:
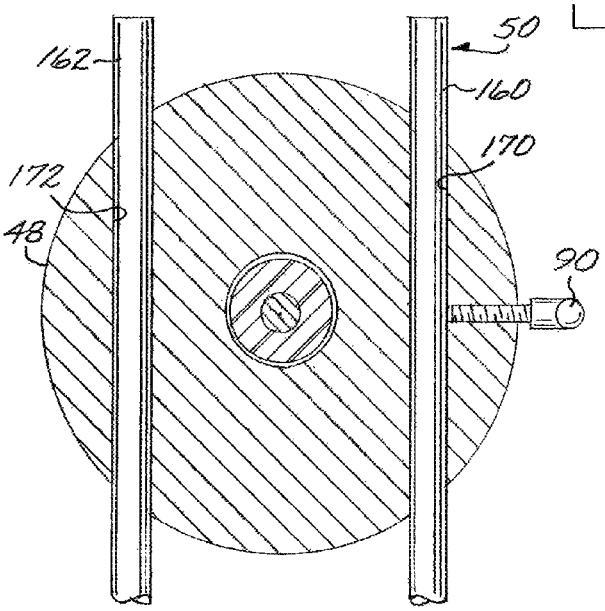
FIG. 10 is a cross section view taken on Line 10-10 of FIG. 9 showing the proximate end of the user crank inserted into the handle hub and locked in place by the user crank T handle bolt.

Returning to FIG. 9, the cross sectional view of the handle hub 48 depicted provides a view of the handle receiver bores 170 and 172 wherein bore 170 is intersected by crank T handle bolt 90. Various handle or user crank 50 types may be fitted to the handle hub 48; however, all handles types have round crank arm rods 160 and 162 that are received by bores 170 and 172 and secured in place by crank T handle bolt 90 performing the function of a set screw against the crank rod 170 as further illustrated in FIG. 10.

Figure 11:
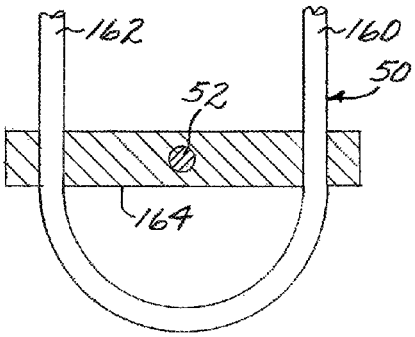
FIG. 11 is a cross section view taken on Line 11-11 of FIG. 1 illustrating the distal end of the user crank and showing the grip mount fixed to the arms of the crank with the user grip post centrally attached to the grip mount.
Figure 17:
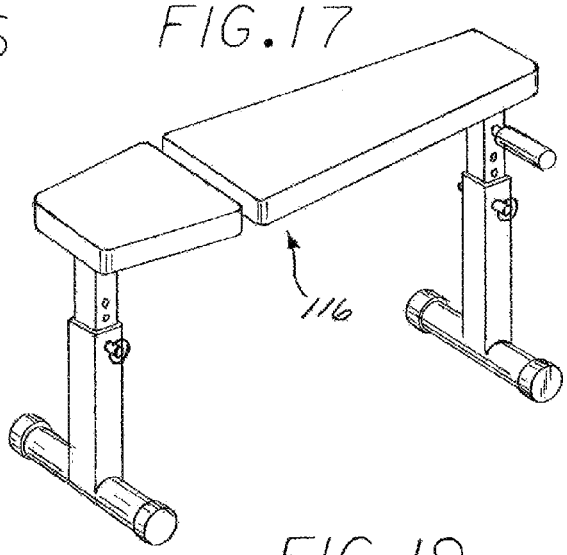
FIG. 17 is a perspective view of an optional horizontal bench accessory facilitating use of the present invention from a supine, reclined or sitting user position.

The various user handle or crank embodiments interact with a user to simulate the motion and load experienced in various user sporting, exercising and rehabilitation activities. A first embodiment of the user crank 50 is illustrated in FIG. 11 wherein the user crank arms are joined at the distal end by a user crank grip support 164 with grip 52 perpendicularly mounted on the support 164. With the same embodiment installed on both resistance units 40 and 42 respectively, the user may optionally stand in front of the apparatus whilst rotating the cranks. An optional adjustable horizontal bench 116 as illustrated in FIG. 17 may be utilized to facilitate interacting with the present invention from a supine, reclined or sitting user position.

Figure 18:
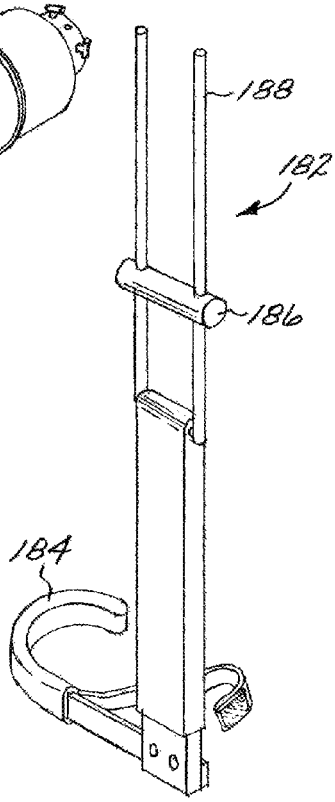
FIG. 18 is a perspective view of a first alternate embodiment of the user crank comprising a user leg securing mechanism.

A second alternate embodiment 182 of the user crank is illustrated in FIG. 18 wherein the crank comprises the requisite arm rods 188 received by a handle hub and having a leg strap 184 fixed to the distal end. The user straps their leg into the assembly thereby providing a load to the user's leg as the leg rotates the handle hub. A grip handle 186 disposed between the arm rods 188 is further provided. The embodiment provides simulation of sporting activities including kicking a ball and motion for rehabilitation.

Figure 19:
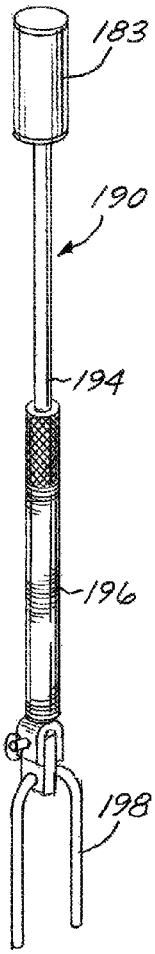
FIG. 19 is a perspective view of a second alternate embodiment of the user crank for exercising the rotator cuff as in simulating throwing or a curl.

A third alternate embodiment 190 of the user crank is illustrated in FIG. 19 and is directed to rotator cuff exercising including simulation of load and motion associated with throwing and curls. An extendable rod 194 has a cylindrically shaped user grip 183 concentrically fixed to the distal end and is received by the arm 196 being fixed to the requisite crank rods 198 for attachment to the handle hub 48.

Figure 20:
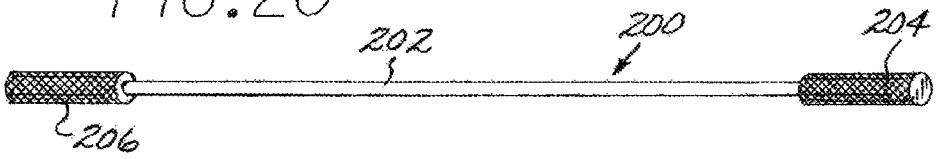
FIG. 20 is a perspective view of a third alternate embodiment of the user crank for providing opposing load to a user's arms for exercising core muscle groups.

In FIG. 20, a fourth alternate embodiment 200 of the user crank is directed towards exercising the core muscle groups and comprises a single crank arm rod 202 mounted in the handle hub 48 through bore 170 and secured centrally along the length of the rod by crank T handle bolt 90. The embodiment has a left grip 206 fixed to one end of the rod 202 and a removable right grip 204 at the opposing end allowing disassembly for purposes of installation in the handle hub.

Figure 21:
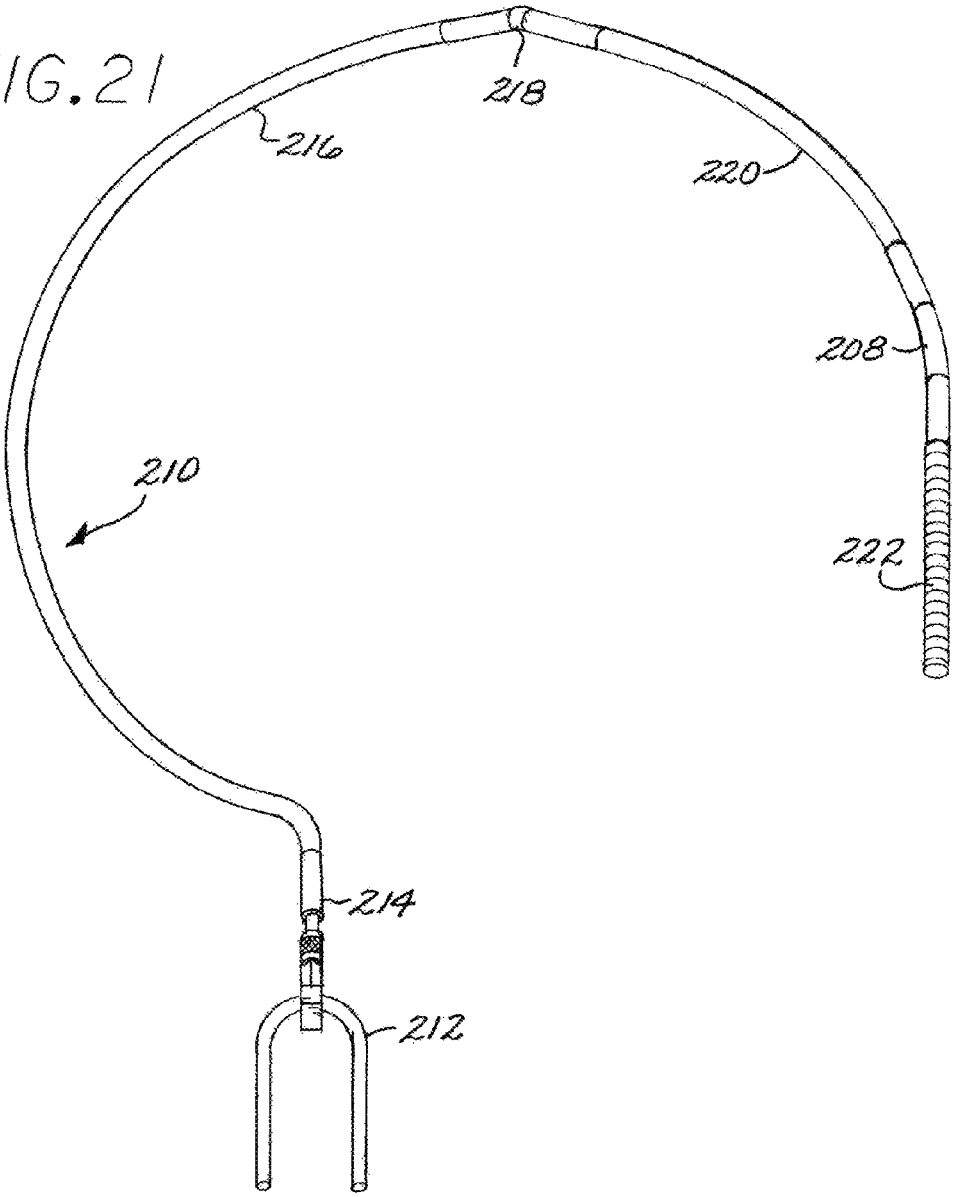
FIG. 21 is a perspective view of a fourth alternate embodiment of the user crank comprising an articulated circular rod with user grip at the distal end primarily directed to simulate the motion of playing golf or batting a ball whilst providing resistance load to develop user strength.

A fourth alternate embodiment 210 of the user crank is illustrated in FIG. 21 directed to the simulation of load and motion as experienced whilst playing golf and batting. The embodiment comprises the requisite crank rods 212 received by a handle hub, the crank rods 212 jointed to the proximate end of a curve shaped circular extension arm 216 by swivel joint 214, the distal end of the curved extension arm 216 further joined to the proximate end of a secondary extension arm 220 by a first flexible joint 218, and the distal end of the secondary curved extension arm 220 further joined to the user grip 222 by a second flexible joint 208. The various joints and swivel of the embodiment facilitate positioning of the user grip 222 to a golfing or batting position, and provide the flexibility allowing simulation of the corresponding activities.

Figure 22:
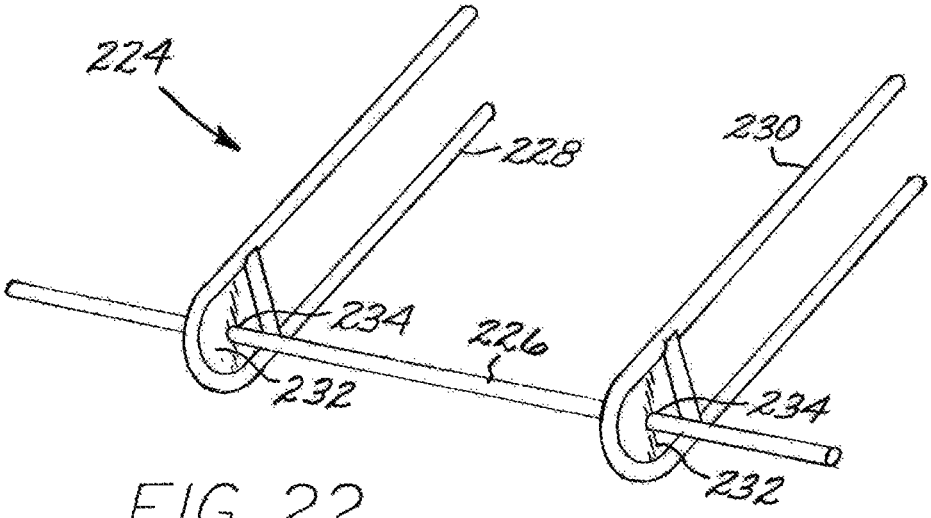
FIG. 22 is a perspective view of a fifth alternate embodiment of the user crank simulating a military bench press.

In FIG. 22, a fifth alternate embodiment 224 of the user crank simulates the loads and motions of a military press and comprises a left crank arm rod 228 received by the handle hub 48 of the left resistance unit 40 and a right crank arm rod 230 received by the handle hub 48 of the right resistance unit 42. A push grip rod 226 is secured by bushings 234 in grip rod mounting plates 232 formed in the distal ends of the crank arm rods.

I claim:

1. A constant resistance load exercise apparatus comprising at least one resistance unit having a housing, a central shaft with proximate and distal ends fixed to the housing, a handle hub disposed concentrically and rotatably to the distal end of the central shaft, a resistance drum, having proximate and distal ends, being cylindrically shaped with a circumferential surface and disposed concentrically and rotatably around the central shaft and having a plate, disposed perpendicular to the central shaft, forming the distal end, a sprag clutch, having a preselected direction of rotation, concentrically disposed between the distal end of the resistance drum and the handle hub, mechanically coupling the resistance drum to the handle hub through the sprag clutch, a friction strap, having inner and outer surfaces, the inner surface disposed around a surface of the resistance drum, a resistance band surrounding the friction strap, the friction strap being retained by fasteners to the resistance band; and, a means for adjusting the tension of the resistance band against the top surface of the friction strap, the means for adjusting the tension of the resistance band being fixed to the housing and resistance band, and disposed between the housing and the resistance band wherein selectably adjusting the tension on the resistance band adjusts the friction between the friction strap and the resistance drum thereby respectively adjusting the force required to rotate the resistance drum relative to the housing.

2. The constant resistance load exercise apparatus of claim 1 wherein the sprag clutch, being a one-way freewheel clutch with inner and outer races, having a spline received by the handle hub and fixed to the inner race and an outer race fixed to the distal end plate of the resistance drum permitting rotation in a preselected direction.

3. The constant resistance load exercise apparatus of claim 1 further comprising a dog gear concentrically disposed on the distal end plate of the resistance drum and a drum locking pin disposed within the handle hub and being selectably positioned to engage the dog gear thereby selectably locking the rotation of the handle hub to the rotation of the resistance drum.

4. The constant resistance load exercise apparatus of claim 1 wherein the means for adjusting the tension of the resistance band further comprises a resistance band shoe contacting the top surface of the friction strap, the resistance band shoe being formed to conform to the circumferential surface of the resistance drum, a tensioner receiver disposed between the resistance band shoe and the resistance band, and a tensioner knob having a threaded tensioner shaft with a distal end, the threaded tensioner shaft being inserted through a bore in the housing, through a bore in the resistance band, and through and engaging a threaded bore in the tensioner receiver with the threaded tensioner shaft distal end contacting the resistance band shoe wherein rotation of the tensioner knob selectably adjusts the tension of the resistance band on the friction strap thereby facilitating adjusting the resistance load of the apparatus.

5. The constant resistance load exercise apparatus of claim 1 wherein the resistance band is constructed from flexible metal sheet.

6. The constant resistance load exercise apparatus of claim 1 wherein the friction strap is constructed from a fabric material having a friction coefficient with metal.

7. The constant resistance load exercise apparatus of claim 1 wherein the handle hub, having a circumference, further comprises at least one handle receiver bore receiving the proximate end of a handle, secured by a bolt, the handle extending outwardly through the handle hub circumference.

8. The constant resistance load exercise apparatus of claim 7 wherein the handle is a crank arm having a crank grip support disposed at the crank arm distal end with a crank grip perpendicularly mounted to the crank grip support thereby facilitating use of the apparatus from standing, supine, reclined and sitting positions.

9. The constant resistance load exercise apparatus of claim 7 wherein the handle comprises a pair of rods having a leg strap fixed to the distal end of the rods and a handle grip disposed between the rods thereby providing sporting motion simulation and rehabilitation.

10. The constant resistance load exercise apparatus of claim 7 wherein the handle comprises a cylindrically shaped user grip fixed concentrically to the distal end of an adjustable length extension rod with the proximate end being the handle proximate end thereby facilitating rotator cuff exercises.

11. The constant resistance load exercise apparatus of claim 1 wherein the handle comprises crank rods received by the handle hub and extending outwardly from the central shaft, the crank rods being joined to the proximate end of a first curved extension arm by a swivel joint, the distal end of the first curved extension arm being further joined to the proximate end of a secondary curved extension arm by a first flexible joint, and the distal end of the curved secondary extension arm further joined to a user grip by a second flexible joint, thereby facilitating golf and batting simulation of load and motion.

12. The constant resistance load exercise apparatus of claim 1 further comprising a handle being a rod received by a bore in the handle hub, having a grip disposed at each end of the rod thereby facilitating core muscle group exercises.

13. The constant resistance load exercise apparatus of claim 1 wherein two resistance units are mounted opposingly with the proximate and distal shaft ends concentrically aligned and the respective sprag clutches each having opposing preselected directions of rotation.

14. The constant resistance load exercise apparatus of claim 13 wherein each handle hub receives the proximate end of a crank arm extending outwardly from the central shaft and a grip rod being disposed between the distal ends of the crank arms thereby facilitating simulation of the motion and load of a military bench press.

15. The constant resistance load exercise apparatus of claim 13 wherein a mounting plate is disposed between the two resistance units, the mounting plate being attached to a mounting bracket.

16. The constant resistance load exercise apparatus of claim 15 wherein the mounting plate is perpendicularly fixed to the mounting bracket comprising a front plate perpendicularly attached to the mounting plate, a rear plate rotatably disposed adjacent to the front plate and secured by a mount shaft disposed through central bores in the front and rear plates, and a mounting sleeve fixed to the rear plate.

17. The constant resistance load exercise apparatus of claim 16 wherein the mount sleeve is received by the top end of a vertical member of a vertical mounting stand, the vertical member having a bottom end with a plurality of ground support members attached and extending radially from the bottom end of the vertical member.

18. The constant resistance load exercise apparatus of claim 16 wherein the mount sleeve is received by a wall mounted bracket.

* * * * *